US005553736A

United States Patent [19]

Healis

[11] Patent Number: 5,553,736

[45] Date of Patent: Sep. 10, 1996

[54] VENDING APPARATUS

[76] Inventor: Frank G. Healis, Box 133, Wagontwn Rd., Wagontown, Pa. 19376

[21] Appl. No.: 349,527

[22] Filed: Dec. 5, 1994

[51] Int. Cl.[6] ..... G07F 11/36

[52] U.S. Cl. ..... 221/62; 221/65; 221/75; 221/101; 221/193; 221/195; 221/283; 221/304

[58] Field of Search ..... 221/75, 61, 62, 221/65, 101, 126, 129, 130, 131, 133, 193, 194, 195, 281, 283, 304, 312 B, 312 R

[56] References Cited

U.S. PATENT DOCUMENTS

| | | | |
|---|---|---|---|
| 1,211,510 | 1/1917 | Wheeler . | |
| 1,699,476 | 1/1929 | Morin . | |
| 1,718,249 | 6/1929 | Morin . | |
| 1,959,809 | 5/1934 | Benjamin . | |
| 2,374,896 | 5/1945 | Reynolds . | |
| 2,719,651 | 10/1955 | Gabrielsen | 221/130 X |
| 2,875,877 | 3/1959 | Hoban . | |
| 2,965,262 | 12/1960 | Du Bois . | |
| 2,975,935 | 3/1961 | Hebel . | |
| 3,000,539 | 9/1961 | Danziger et al. . | |
| 3,190,489 | 6/1965 | Childers et al. . | |
| 3,194,433 | 7/1965 | Heselov . | |
| 3,282,466 | 11/1966 | Meresz et al. . | |
| 3,313,448 | 4/1967 | Suttle et al. . | |
| 3,344,953 | 10/1967 | Krakauer et al. . | |
| 3,348,732 | 10/1967 | Schwarz . | |
| 3,606,081 | 9/1971 | Croteau et al. . | |
| 3,722,745 | 3/1973 | Gushi et al. | 221/130 |
| 3,893,589 | 7/1975 | Mandell | 221/123 |
| 3,908,859 | 9/1975 | Hohmann | 221/118 |
| 4,032,039 | 6/1977 | Schuller | 221/75 |
| 4,155,484 | 5/1979 | Pastore | 221/35 |
| 4,284,208 | 8/1981 | Levasseur | 221/129 |
| 4,301,909 | 11/1981 | Snavely | 194/2 |
| 4,483,459 | 11/1984 | Taylor et al. | 221/130 X |
| 4,600,121 | 7/1986 | Falk et al. | 221/130 |
| 4,674,653 | 6/1987 | Suzuki | 221/75 X |
| 4,744,490 | 5/1988 | Albright et al. | 221/75 |
| 4,757,915 | 7/1988 | Albright et al. | 221/75 |
| 4,844,294 | 7/1989 | Albright | 221/75 |
| 4,942,980 | 7/1990 | Hellermann et al. | 221/244 |
| 5,064,092 | 11/1991 | Grossi | 221/75 |
| 5,186,355 | 2/1993 | VonDelinde et al. | 221/75 |
| 5,236,103 | 8/1993 | Ficken et al. | 221/124 |

OTHER PUBLICATIONS

"Introducing The Compact Cold Drink Machine", sales brochure, 1990.

"Compact Cold Drink Machine", sales brochure, 1987.

*Primary Examiner*—William E. Terrell
*Assistant Examiner*—Dean A. Reichard
*Attorney, Agent, or Firm*—Paul & Paul

[57] ABSTRACT

A vending apparatus for supplying articles such as snacks is disclosed. Articles to be dispensed from the apparatus travel horizontally in a direction parallel with the front surface of the apparatus to a position from which the articles drop through a vertical shaft at the side of the apparatus to a delivery area. The apparatus is compact in size and is capable of holding a large inventory of different snack articles. The apparatus has a low profile and may be mounted to a wall by means of a mounting bracket.

19 Claims, 10 Drawing Sheets

VENDING APPARATUS

FIELD OF THE INVENTION

The present invention relates to vending machines, and more particularly to vending machines for supplying products such as snacks and the like. The vending machines are compact in size, and are capable of holding a large inventory of different products. In a preferred embodiment, the vending machines are adapted for mounting to a wall and extend only a short distance from the wall.

BACKGROUND OF THE INVENTION

Various types of vending machines have been used to supply items such as snacks, beverages and cigarettes. One type of conventional vending machine uses the force of gravity to sequentially feed items to a delivery bin. Such gravity-feed machines are disclosed in U.S. Pat. Nos. 2,965,262 and 3,606,081. Gravity-feed vending machines are particularly suited for the delivery of beverages in cylindrical containers, wherein the containers are caused to roll along a series of ramps to the delivery area. U.S. Pat. No. 3,606,081 discloses such a beverage vending machine having a series of ramps forming a serpentine configuration.

Conventional snack vending machines typically comprise an array of helical feeder coils having axes perpendicular to the front face of the vending machine. Upon the selection of a particular item, the helical coil corresponding to that item is rotated one turn in order to push the item off the front edge of a shelf located at the front of the machine. Such helical coil vending machines require a relatively large clearance space at the front of the machine in order to allow the items to drop into the delivery bin. This clearance space adds significantly to the depth of such machines. In addition, the holding capacity of each helical coil is limited by the depth of the machine. For bulky or thick items such as bags of potato chips, pretzels and the like, the spacing between each coil of the helix must be relatively large, thereby limiting the number of items that can be held by a coil. In conventional front-facing vending machines, this is a particular problem because the depth of the machine limits the number of bulky items that can be held by a given coil. Thus, in conventional helical coil snack machines, it is often necessary to place a bulky snack item in more than one helical coil in order to provide sufficient inventory, which disadvantageously limits the variety of snack items that can be vended from the machine. Accordingly, the depth of such conventional machines must be relatively large in order to hold a sufficient number of different snack items. U.S. Pat. Nos. 3,344,953, 5,186,355 and 5,236,103 illustrate conventional helical coil vending machines.

U.S. Pat. No. 4,744,490 discloses a relatively compact snack vending machine that can be placed on a table. While the table-mounted vending machine is more compact than conventional free-standing machines, it suffers from low holding capacity and has not gained wide-spread commercial use. The table-mounted machine disclosed in U.S. Pat. No. 4,744,490 is similar to conventional free-standing snack machines, in that helical coils are used to move the selected items toward the front of the unit, where the items drop off the front edge of a shelf into a delivery bin. As with the free-standing machines, the clearance space required at the front of the table-mounted unit adds significantly to the depth of the machine.

U.S. Pat. Nos. 4,600,121 and 4,942,980 disclose cigarette vending machines comprising relatively complicated mechanisms for dropping individual packs of cigarettes into a delivery area. As with the prior art snack vending machines, these cigarette vending machines require lateral movement of the items toward or away from the front face of the machines, which adds significantly to the depth of the machines.

The present invention has been developed in view of the foregoing and to overcome other deficiencies of the prior art.

SUMMARY OF THE INVENTION

An object of the present invention is to provide a novel vending machine.

Another object of the present invention is to provide a vending apparatus comprising an enclosure having front, back and side surfaces, and including means for moving articles in a substantially horizontal direction substantially parallel with the front surface of the apparatus to a position from which the articles drop through a substantially vertical shaft located adjacent to one of the side surfaces of the enclosure to a delivery area.

A further object of the present invention is to provide a compact vending machine of minimal depth that can be mounted to a wall, and which is capable of holding a large inventory of different snack articles.

Another object of the present invention is to provide a vending apparatus comprising an enclosure having front, back and side surfaces, and including means for moving articles in a substantially horizontal direction substantially parallel with the front surface of the apparatus to a position from which the articles drop to a delivery area, wherein the apparatus comprises a bracket for securely mounting the apparatus to a substantially vertical surface.

These and other objects of the present invention will be more readily understood by consideration of the following detailed description of the invention.

DETAILED DESCRIPTION OF THE PREFERRED EMBODIMENTS

Figure 1:
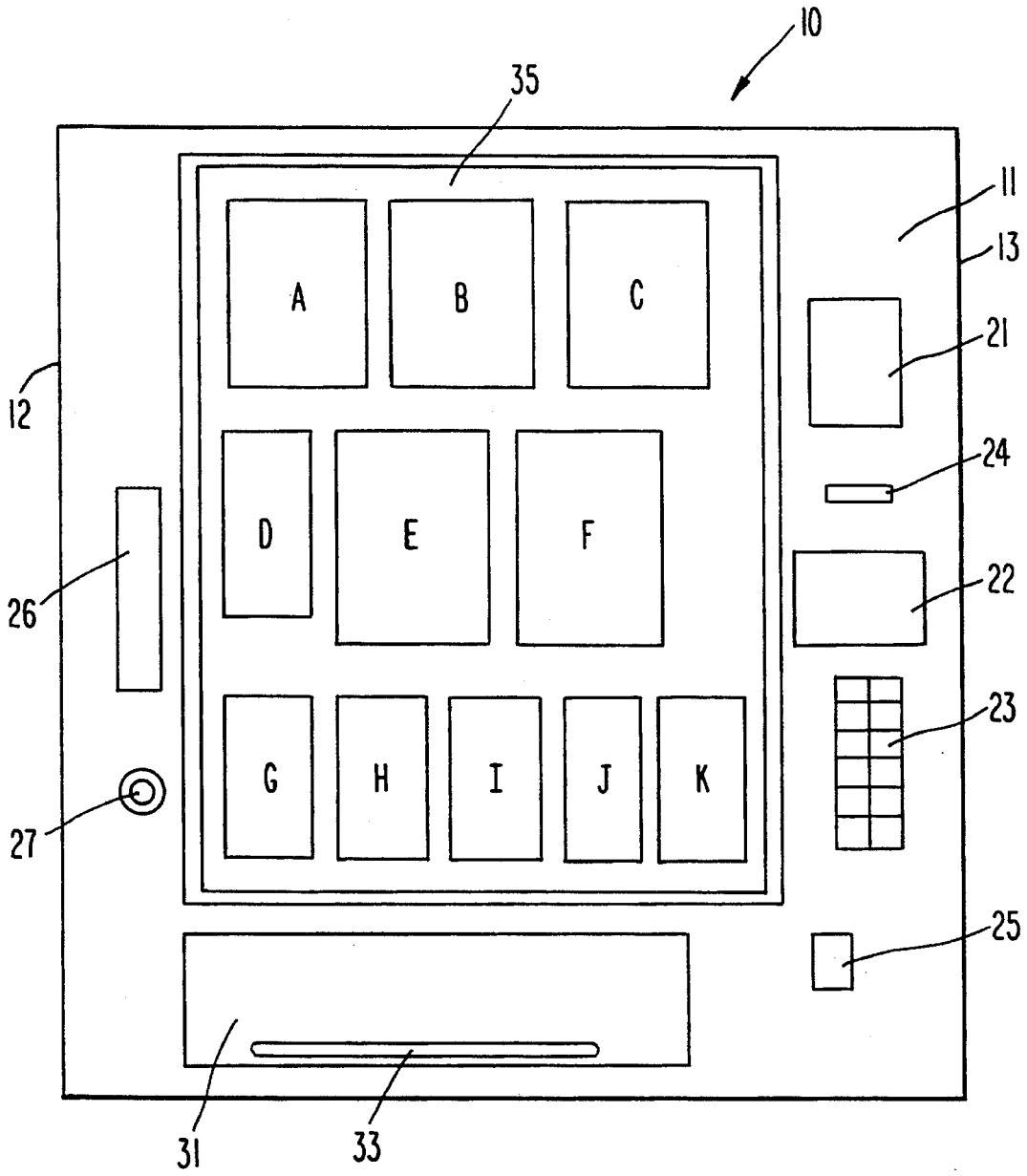
FIG. 1 is a partially schematic front view of a vending apparatus in accordance with the present invention.

Referring to the drawings, wherein like reference numbers indicate like elements throughout the several figures, FIG. 1 shows the front of a vending apparatus 10 in accordance with an embodiment of the present invention. The vending apparatus 10 includes a front surface 11, a left side surface 12 and a right side surface 13. A product display area 35 displays the different products A–K contained in the apparatus. In a preferred embodiment, individual articles are displayed in the area 35 under a transparent panel, such as plexiglass. The articles may be held on the front surface 11 of the apparatus by metal clips or any other suitable type of fastener. While it is preferred to display an actual sample of each individual article in the product display area 35, it is also possible to display labels, packaging and the like corresponding to the individual articles.

The vending apparatus 10 of the present invention is preferably provided as a compact unit suitable for wall mounting. For example, in a particularly preferred embodiment, the height of the apparatus shown in FIG. 1 may be about 34 inches, while the width of the apparatus may be about 32 inches. Furthermore, in the preferred embodiment, the depth of the apparatus, as shown most clearly in FIG. 3, may be about 12 inches. Thus, the vending apparatus 10 is compact and has a low profile, and is also capable of holding a large inventory of different articles. For example, the vending apparatus may hold over 100 separate products.

As shown in FIG. 1, a dollar bill acceptor 21 and a coin accepter 22 are located towards the right side of the vending apparatus 10. A keypad 23, LED readout 24 and coin return 25 are also located near the right side of the vending apparatus 10. A handle latch 26 and key lock 27 are located near the left side of the apparatus. A delivery bin door 31 and a handle 33 are located on the front surface 11 near the bottom of the apparatus.

Figure 2:
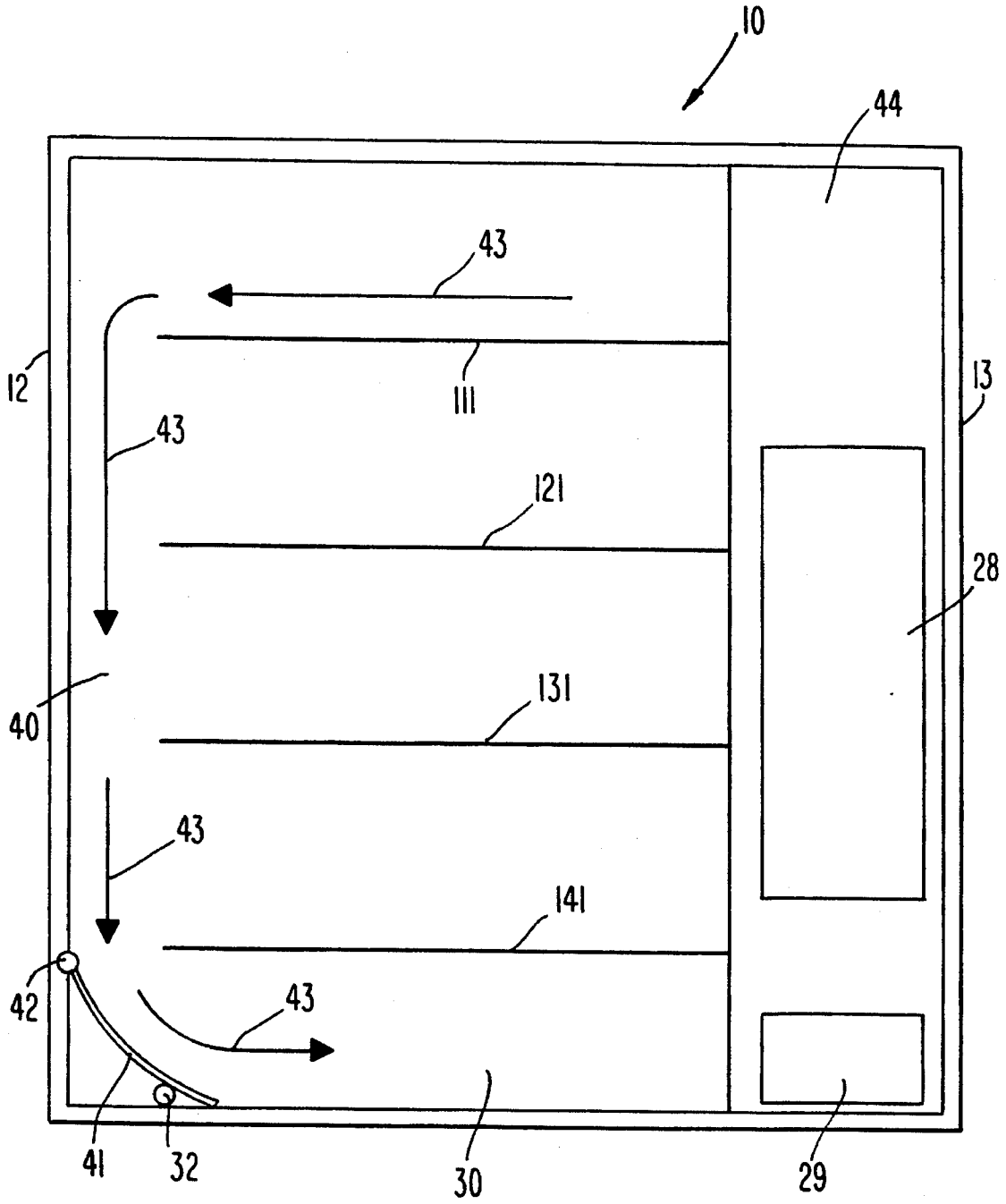
FIG. 2 is a partially schematic front view of the vending apparatus of FIG. 1, with the front cover removed to reveal a column of article-holding shelves.

The dollar bill acceptor 21 includes a conventional dollar bill validator (not shown) that will accept valid one dollar bills and, optionally, bills of higher denomination. Once bills and/or coins are deposited in the apparatus, the amount of credit that has been established is shown on the LED readout 24. The purchaser then uses the keypad 23 to designate the product to be vended. In the preferred embodiment, the keypad 23 comprises numbers or letters corresponding to each of the individual articles A–K. For example, each of the articles A–K may be fastened in the product display area 35 by a clip bearing a number that corresponds to a number on the keypad 23. Once an article has been selected and vended, the LED readout 24 indicates the amount of change paid into the coin return 25. As shown in FIG. 2, a conventional coin mechanism 28 is used to dispense the proper amount of change into the coin return 25. A cash box 29, shown in FIG. 2, is used to store the dollar bills and coins deposited in the vending apparatus.

The LED readout 24 can perform several functions, including selection information and price information. The readout can show the amount of credit established with the insertion of each coin or dollar bill, can indicate if an individual article is sold out and can instruct the customer to select another article if it is sold out. The readout may also display the amount of change to be returned to the customer. The readout 24 may be used to display messages such as "exact change only", "check selection price" and "make alternate selection".

Suitable coin mechanisms for use in accordance with the present invention include Coinco Model Nos. 9302-L, 9302-L+ and 9342-L, and Mars Model No. MC6010. A Coinco Model LF 40 select controller may be used as the keypad 23 with a conventional keypad interface and a changer interface. Suitable dollar bill validators for use in accordance with the present invention include Maka Model NBE-20, Mars Models VMF-1 and VMF-3, and Coinco Model CBA-II.

As shown in FIG. 1, the vending apparatus 10 includes a handle latch 26 and key lock 27 for securing the front surface 11 to the apparatus 10. As shown most clearly in FIG. 4, the front surface 11 is pivotally mounted to the apparatus by a hinge 17. The hinge 17 is preferably a piano-type hinge welded to the front surface 11 and fastened to the right side surface 13 by machine screws or the like. The hinge 17 cannot be removed from the apparatus without access to the interior of the apparatus. The handle latch 26 preferably comprises a cam or other suitable mechanism (not shown) that engages an insert located inside the apparatus to securely close the front surface 11 against the left side surface 12. To provide further securement, the handle latch 26 may also include a conventional locking bar mechanism (not shown) for securing the upper and lower portions of the front surface 11 to the left side surface 12. Through the use of the handle latch 26, key lock 27 and hinge 17, the vending apparatus 10 is secured against unauthorized entry.

FIG. 2 schematically illustrates a vending apparatus of the present invention with the front surface removed. A vertical shaft 40 is located adjacent to the left side surface 12 of the apparatus, while a mechanical area 44 is located adjacent to the right side surface 13. Horizontal shelves 111, 121, 131 and 141 are disposed between the vertical shaft 40 and the mechanical area 44. A delivery slide 41 is located at the bottom of the vertical shaft 40, and is pivotally mounted to the left side surface 12 by a hinge 42. The delivery slide 41 is adapted to rotate counter clockwise about the hinge 42 from an open position as shown in FIG. 2 to a blocking position that seals off the vertical shaft 40, as more fully described below.

Figure 3:
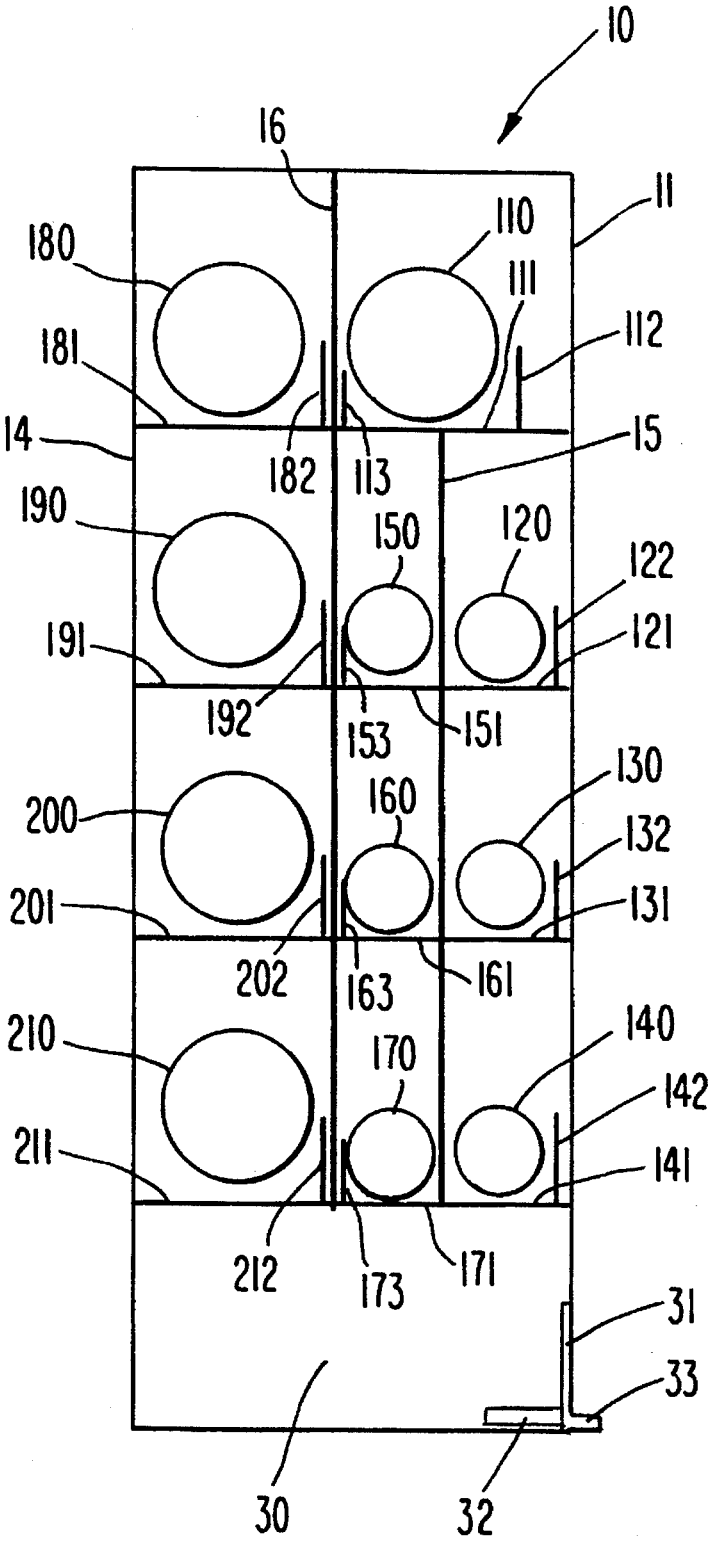
FIG. 3 is a partially schematic left side view of the vending apparatus of FIG. 1, with the left side cover removed to reveal multiple rows and columns of helical coils for transporting articles to a delivery area.

A delivery area 30 is located at the bottom of the apparatus, as shown in FIGS. 2 and 3. The delivery area 30 is preferably accessible from the front surface 11 of the apparatus by means of the delivery bin door 31 and handle 33. While a sliding delivery bin door 31 is shown in the figures, it is understood that any suitable means may be used to allow removal of the vended articles from the delivery area 30. Thus, for example, various types of sliding or pivoting doors may be used, or an open delivery bin may be used without a door. The delivery bin door 31 may be slid vertically upward from the position shown in FIG. 3, and includes an actuator rod 32 that contacts the delivery slide 41 in order to move the delivery slide into a blocking position when the delivery bin door 31 is opened.

As shown in FIG. 2, a preferred vending apparatus in accordance with the present invention includes a series of horizontal shelves 111, 121, 131 and 141 disposed above each other to form a column. As illustrated by the arrows 43 in FIG. 2, articles located on a particular horizontal shelf are sequentially moved from right to left along the shelf in a horizontal direction parallel with the front surface of the apparatus to a position from which the articles drop through the vertical shaft 40 to the delivery area 30. Thus, as shown in FIG. 2, the articles first move horizontally from right to left, and then drop vertically to the delivery area 30. Since, the articles move substantially within the plane defined by FIG. 2, with substantially no movement perpendicular to the plane of FIG. 2, the depth or profile of the apparatus 10 is substantially reduced in comparison with conventional snack vending machines. In the preferred embodiment, a helical coil is disposed above each horizontal shelf to move the articles horizontally along each shelf, as more fully described below.

FIG. 3 is a partially schematic left side view of the vending apparatus of FIGS. 1 and 2, with the left side surface 12 removed. The vending apparatus 10 comprises a series of rows and columns of horizontal shelves, each of which includes a helical coil for transporting the articles. The vending apparatus 10 thus includes a bank of horizontal shelves 111, 121, 131, 141, 151, 161, 171, 181, 191, 201 and 211, and a bank of helical coils 110, 120, 130, 140, 150, 160, 170, 180, 190, 200 and 210. In the preferred embodiment shown in FIG. 3, a total of 11 helical coils are provided for dispensing 11 different types of articles. Large helical coils 110, 180, 190, 200 and 210 are adapted for delivering large or bulky articles, such as potato chips, pretzels and pastries. Small helical coils 120, 130, 140, 150, 160 and 170 are adapted for delivering smaller articles, such as candy, chewing gum and the like. In the preferred embodiment of FIG. 3, each of the large helical coils is capable of holding at least 10 articles, while each of the small helical coils is capable of holding at least 12 articles. Thus, the apparatus is preferably capable of holding at least 122 separate articles.

Vertical walls 112, 113, 122, 153, 132, 163, 142, 173, 182, 192, 202 and 212 are located adjacent to the helical coils in order to provide containment for the articles as they are being loaded into the vending apparatus, as more fully described below. Each of the vertical walls extends from a corresponding horizontal shelf to provide containment for each of the helical coils.

Figure 4:
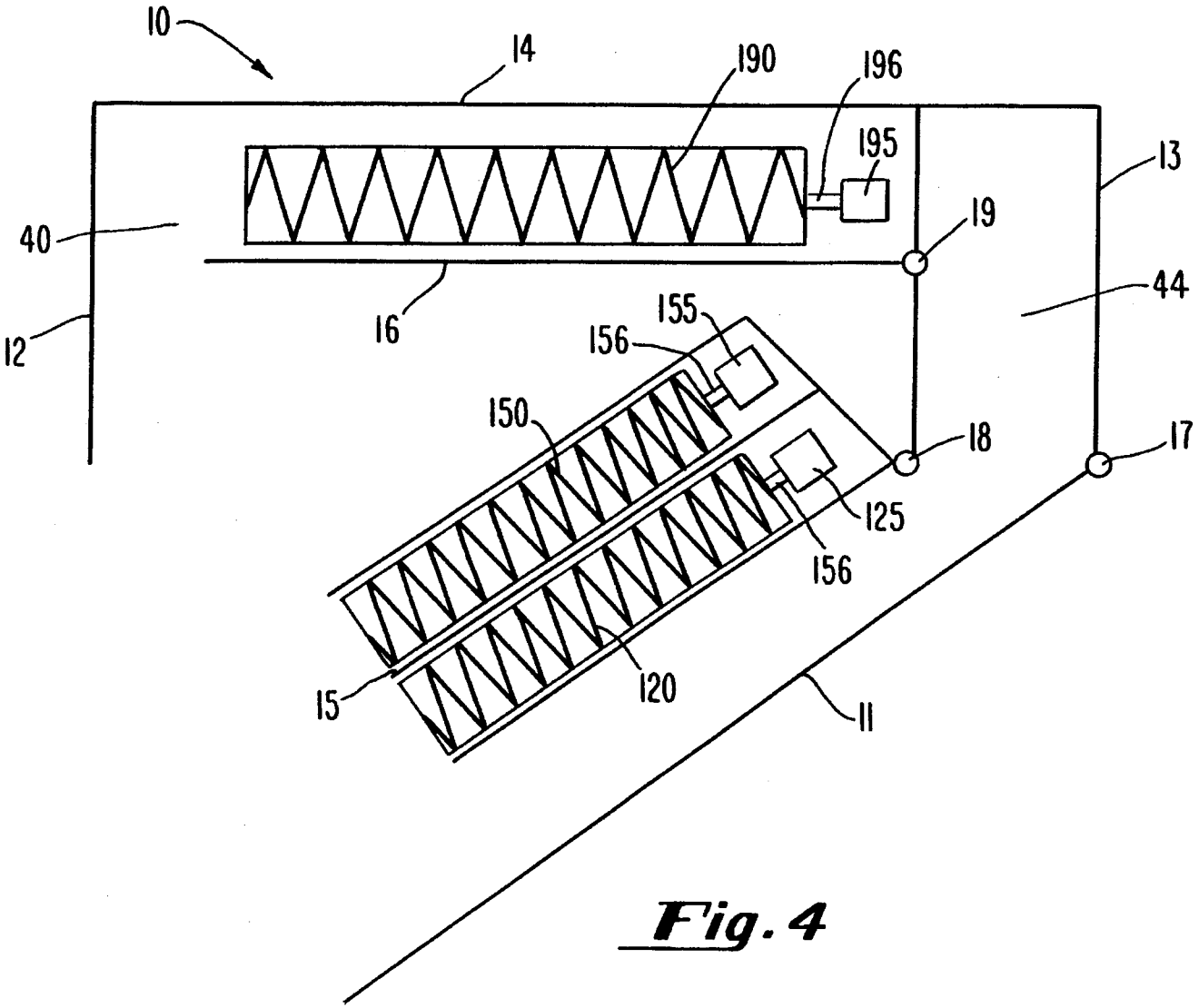
FIG. 4 is a partially schematic top section view of the vending apparatus of FIG. 1, illustrating the hinged front cover of the apparatus in an open position, and illustrating the pivotal movement of columns of helical coils away from each other to facilitate stocking of the machine.

As shown in FIGS. 3 and 4, the vending apparatus 10 in accordance with a preferred embodiment of the present invention includes a front partition 15 and a back partition 16, which provide further containment for the articles that are loaded in the helical coils. The back partition 16 separates the rear column of helical coils 180, 190, 200 and 210 from the rest of the coils. The front column of small helical coils 120, 130 and 140 is separated from the middle column of small coils 150, 160 and 170 by the front partition 15. As shown most clearly in FIG. 4, the back partition 16 is pivotally mounted on the apparatus by a hinge 19. In addition, the forward helical coils 110, 120, 130, 140, 150, 160 and 170 are pivotally mounted on the apparatus by a hinge 18.

The vending apparatus 10 may be loaded with articles by first rotating the front surface 11 counter clockwise about the hinge 17 to an open position, as shown in FIG. 4. Next, the front and middle columns of helical coils are rotated counter clockwise about the hinge 18 to an open position, as shown in FIG. 4, to provide access to the rear column of helical coils. The back partition 16 is then rotated counter clockwise about the hinge 19 from a closed position, as shown in FIG. 4, to an open position. The rear column of helical coils 180, 190, 200 and 210 can then be stocked with the desired articles, followed by rotation of the back partition 16 to a closed position, as shown in FIG. 4. The remaining helical coils can then be loaded with the desired articles. Once loaded, the columns of helical coils 110, 120, 130, 140, 150, 160 and 170 can be rotated clockwise about the hinge 18 from the open position, shown in FIG. 4, to a closed position. The front surface 11 may then be rotated clockwise about the hinge 17 to a closed position to secure the apparatus from unauthorized access.

During loading of the vending apparatus, the vertical walls 112, 113, 122, 132, 142, 153, 163, 173, 182, 192, 202 and 212 are used to retain the loaded articles in the helical coils in order to prevent the articles from falling from the horizontal shelves. The vertical walls are of such a height that they retain the articles within the helical coils, while at the same time allowing sufficient access to the coils to load the articles therein. When the front surface 11, front partition 15, and back partition 16 are in the closed position as shown in FIG. 3, each of the helical coils is disposed in a containment channel comprising the horizontal shelf below the coil and two vertical walls on opposite sides of the coil.

Once an article has been dispensed to the delivery area 30, the purchaser may lift the delivery bin door 31 vertically from the position shown in FIG. 3 to a position that allows access to the delivery area 30. The actuator rod 32 travels vertically upward with the delivery bin door 31 as it is being raised such that the actuator rod 32 contacts the delivery slide 41 to rotate the slide counter clockwise about the hinge 42 from an open position as shown in FIG. 2 to a blocking position that prevents access to the vertical shaft 40. Thus, opening of the delivery bin door 31 causes the delivery slide 41 to move from a deflecting position, as shown in FIG. 2, to a blocking position that prevents theft of articles from the vending apparatus.

As shown in FIG. 4, each helical coil is drivingly connected to a motor by means of a shaft. For example, the helical coil 190 is connected to a motor 195 by a shaft 196. In a similar manner, the helical coil 150 is driven by the motor 155 by means of the shaft 156, while the helical coil 120 is driven by the motor 125 by means of the shaft 126. Each of the motors 125, 155 and 195 is connected to a voltage source by means of conventional electrical connectors (not shown).

Figure 5:
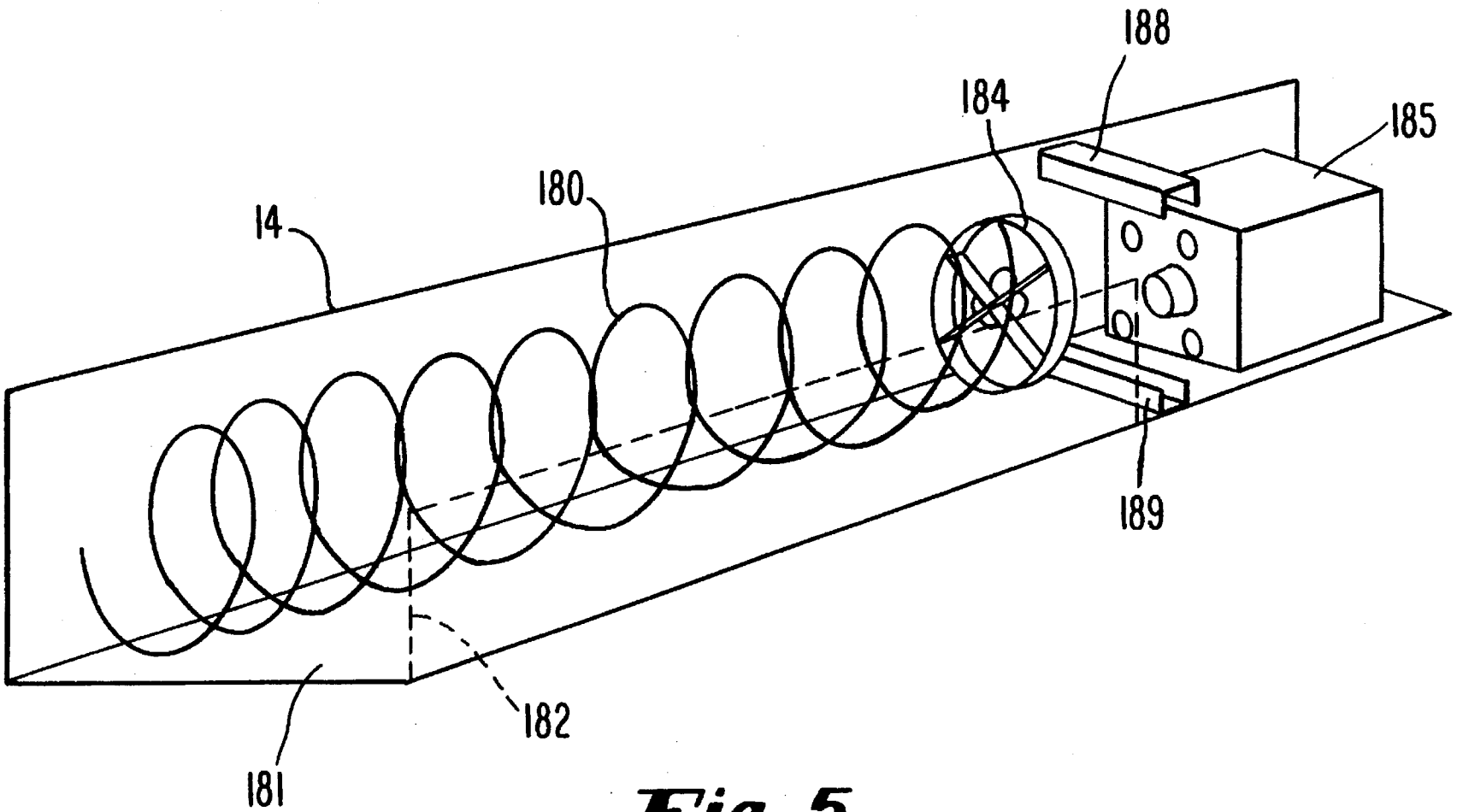
FIG. 5 is a partially schematic oblique view of a helical coil disposed in a containment channel, along with a motor for driving the helical coil, in accordance with the present invention.

In FIG. 5, a perspective view of an individual helical coil 180 and its motor 185 is shown, with the drive shaft and the mounting plate for the motor removed for purposes of clarity. As shown in FIG. 5, the helical coil 180 is located in a containment channel formed by the horizontal shelf 181, the vertical wall 182 (shown in phantom) and a portion of the back surface 14 of the apparatus. The helical coil 180 is attached to a mounting disk 184, which in turn is attached to the motor 185 by means of a shaft (not shown). An upper mounting channel 188 is attached to the back surface 14 and/or upper surface of the apparatus by any suitable means such as welding, fasteners and the like. A lower mounting channel 189 is attached to the horizontal shelf 181 and, optionally, to the back surface 14 of the apparatus by any suitable means. As described more fully below, the upper and lower mounting channels 188 and 189 form a slide that allows the motor 185 to be slidably removed from the apparatus.

Figure 6:
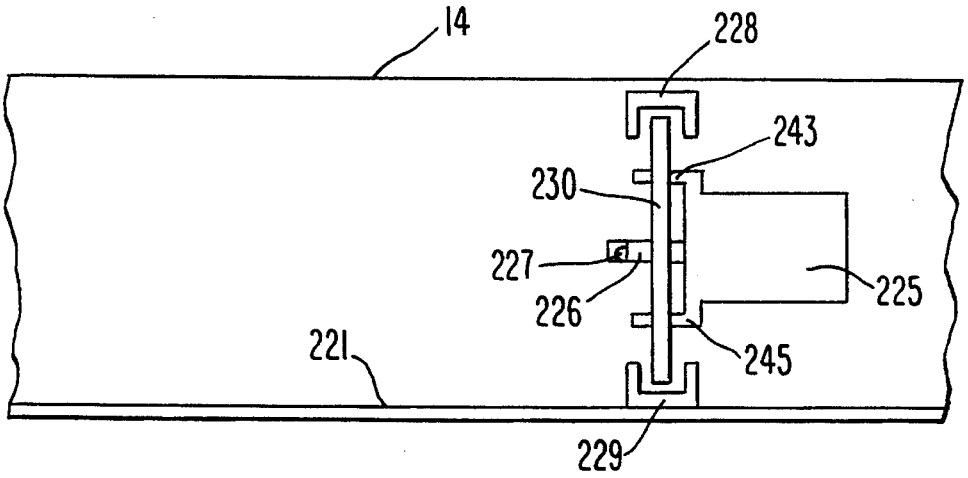
FIG. 6 is a partially schematic front view of a motor for driving a helical coil in accordance with the present invention, including channels for slidably mounting the motor in the vending apparatus.

FIG. 6 is a partially schematic front view of a motor mounting mechanism that allows each helical coil motor to be slidably removed from the vending apparatus. The motor 225 is attached to a motor mount plate 230 by means of retaining pins 243 and 245. While only two retaining pins 243 and 245 are visible in FIG. 6, there are preferably two additional retaining pins located behind the retaining pins 243 and 245 to provide a total of four retaining pins for attachment of the motor 225 to the motor mount plate 230. The motor 225 drives the shaft 226, which includes a keyed opening 227 for attachment to the mounting disk of the helical coil (not shown). An upper mounting channel 228 is attached to a portion of the back surface 14 of the apparatus and/or to a horizontal surface above the channel (not shown), while a lower mounting channel 229 is attached to the horizontal shelf 221. The upper and lower mounting channels 228 and 229 thus form a slide into which the motor mount plate 230 can be inserted and removed in a direction perpendicular to the plane of FIG. 6.

Figure 7:
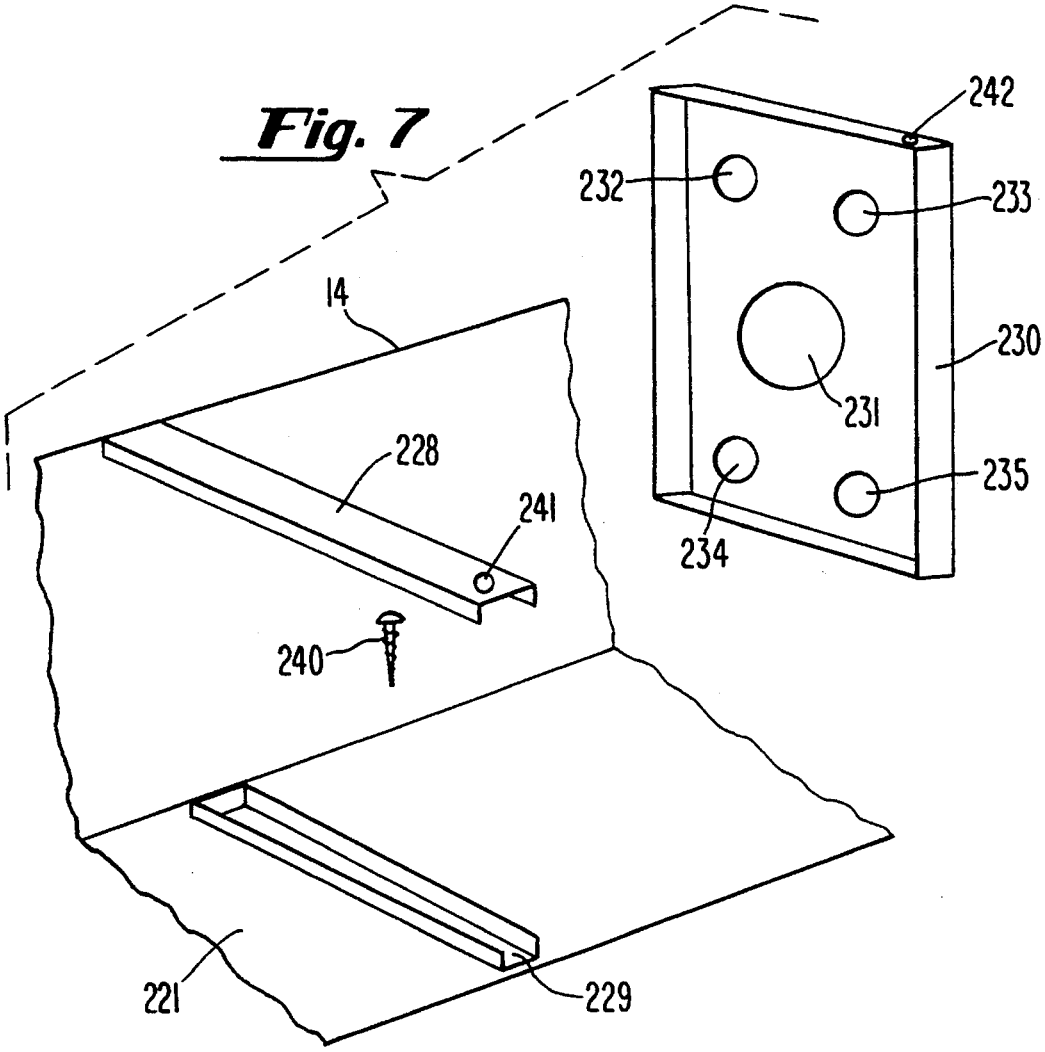
FIG. 7 is a partially schematic exploded oblique view of a motor mounting plate and mounting channels for receiving the plate, in accordance with the present invention.

FIG. 7 is an exploded view of some of the components of a removable motor mounting in accordance with the present invention. The motor mount plate 230 includes a shaft hole 231 that allows the motor shaft (not shown) to pass through the plate. The motor mount plate 230 also includes four retaining pin holes 232, 233, 234 and 235 that engage four corresponding retaining pins of the motor (not shown) to thereby secure the motor to the plate 230 and to prevent rotation of the motor. The upper portion of the motor mount plate 230 is slidably receivable in the upper mounting channel 228, while the lower portion of the motor mount plate 230 is slidably receivable in the lower mounting channel 229. When the motor mount plate 230 is fully inserted in the mounting channels, a hole 241 in the upper mounting channel 228 is aligned with a hole 242 in the motor mount plate 230. A pin 240 or other suitable fastener may then be passed through the holes 241 and 242 to secure the motor mount plate 230 in the upper and lower mounting channels 228 and 229. While the hole 241 is disposed in the upper horizontal portion of the mounting channel 228 in FIG. 7, it may be preferable to locate the hole 241 in at least one of the vertical side walls of the mounting channel 228. In this manner, the pin 240 can be inserted horizontally from the side into the mounting channel rather than from the top as shown in FIG. 7. In addition, while FIG. 7 illustrates that the pin 240 is to be inserted through the hole 242 in the motor mount plate 230, the pin 240 may alternatively be located to the side of the plate 230 without passing through the plate. In the preferred embodiment, the pin 240 can be inserted and removed from the holes 241 and 242 by hand, without the use of any type of tool. Thus, the motor mount plate 230, along with the helical coil motor, can be easily removed from the vending apparatus without the use of tools. Once a helical coil motor is mounted in the apparatus, electrical connection to the motor is made by means of any suitable electrical connector or plug.

In accordance with the present invention, if replacement of a motor or helical coil is desired, the motor may be unplugged from its electrical connection and the pin may be removed from the upper mounting channel to allow the motor and helical coil to be removed from the apparatus. A new motor and coil assembly can then be easily slid into place without the need for any type of tool. Thus, any down time due to the replacement of a motor or helical coil is substantially reduced. In addition to removing both the motor and helical coil as a unit, it is also possible to remove either one of these components separately by detaching the coil from the motor, if desired.

Figure 8:
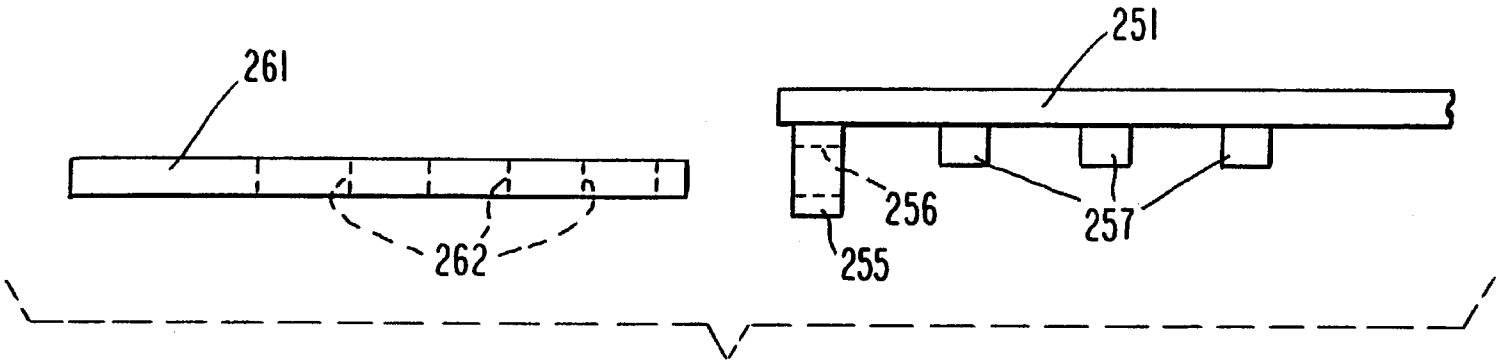
FIG. 8 is a partially schematic exploded front view of a horizontal article-holding shelf including an adjustable portion for extending the length of the shelf, in accordance with the present invention.
Figure 9:
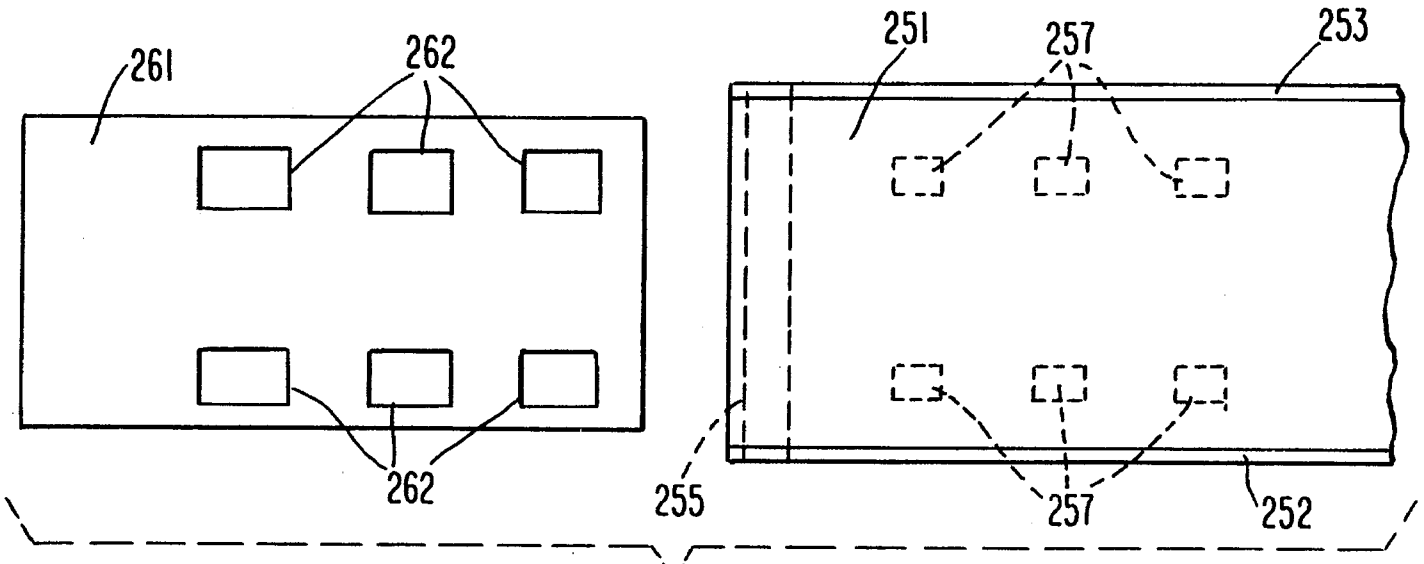
FIG. 9 is a partially schematic exploded top view of the adjustable shelf of FIG. 8.
Figure 10:
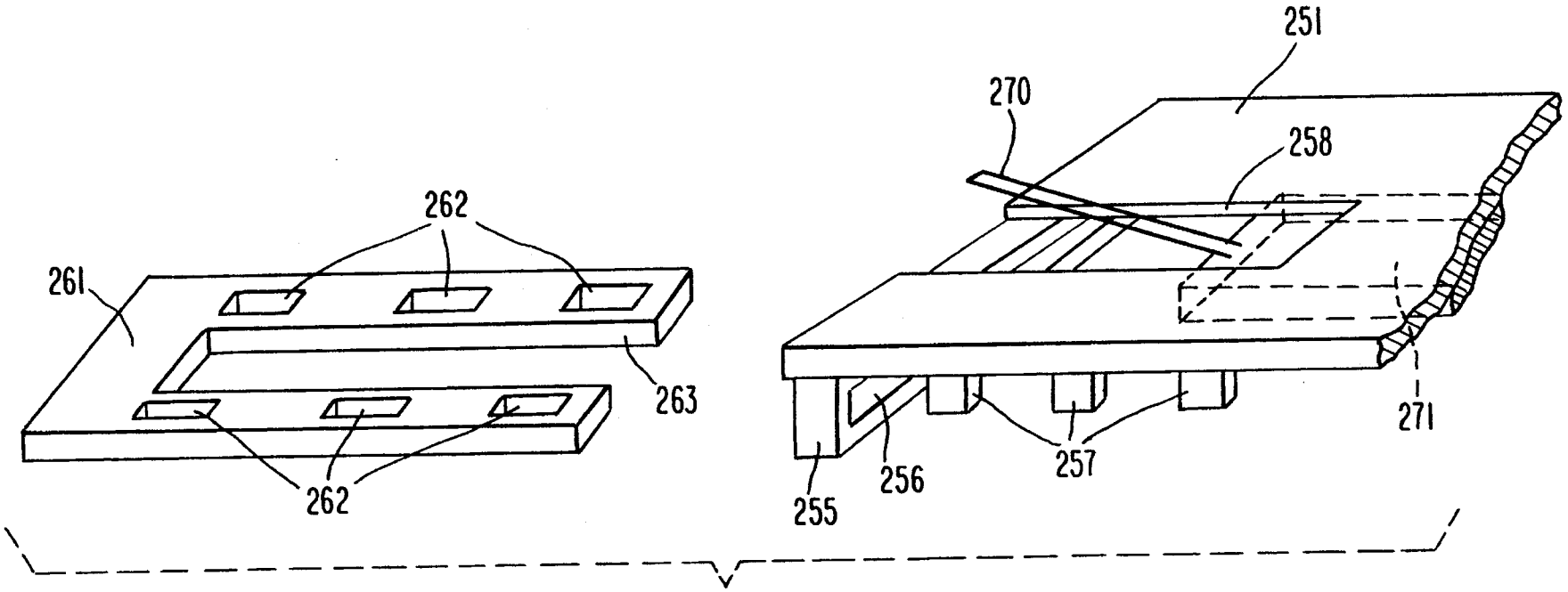
FIG. 10 is a partially schematic exploded front elevated view of an adjustable shelf similar to that shown in FIGS. 8 and 9, including a wire mechanism for indicating when the articles on the shelf have been depleted.

FIGS. 8, 9 and 10 illustrate an adjustable shelf feature in accordance with an embodiment of the present invention. A horizontal shelf 251 is connected to vertical walls 252 and 253 (shown only in the top view of FIG. 9 for purposes of clarity). A support guide 255 is attached below the horizontal shelf 251 and includes a guide slot 256. A series of projections 257 extend from the lower surface of the horizontal shelf 251. An extension shelf 261 is provided with a series of extension holes 262. The extension shelf 261 may be slid through the guide slot 256 of the support guide 255 to engage in different positions, wherein the projections 257 of the horizontal shelf 251 engage in different extension holes 262 of the extension shelf 261. When the extension shelf 261 is in the fully retracted position, all six of the projections 257 are inserted in the corresponding six extension holes 262. In the fully extended position, only the two leftmost projections 257, as shown in FIG. 9, engage in the two rightmost extension holes 262 of the extension shelf 261.

Each horizontal shelf of the vending apparatus may be provided with such an extension shelf in order to provide for the vending of different types and sizes of articles. Thus, depending on the size or bulk of an article, it is possible to adjust the length of the horizontal shelf such that the article will fall from the edge of the shelf when the helical coil completes its rotation. Since no tools are required to move the extension shelf, adjustments to the length of the horizontal shelves can be made quickly and easily.

FIG. 10 illustrates an embodiment similar to the embodiment of FIGS. 8 and 9, with the addition of an indicator wire 270 that senses when there are no further articles on the horizontal shelf 251. The indicator wire 270 extends at an angle through a slot 258 in the horizontal shelf 251. The indicator wire 270 is connected to an indicator housing 271 that is in electrical contact with the LED readout 24 of the vending apparatus. In this embodiment, the extension shelf 261 is provided with an extension slot 263 that provides space for the indicator housing 271 when the extension shelf 261 is in the fully retracted position. When the indicator wire 270 is in the up position as shown in FIG. 10, a switch contained in the indicator housing 271 is opened, thereby preventing a vend from being made. When the switch is in the open position, a signal may also be sent to the LED readout 24 to display a message such as "sold out", "make another selection" or the like. If an article is located in the last helix of the helical coil at the edge of the horizontal shelf 251, the weight of the article presses the indicator wire 270 down to complete the circuit in the indicator housing 271, thereby allowing a vend to take place. In this manner, the vending apparatus automatically senses when a helical coil is empty, and displays that information to the purchaser.

Figure 11:
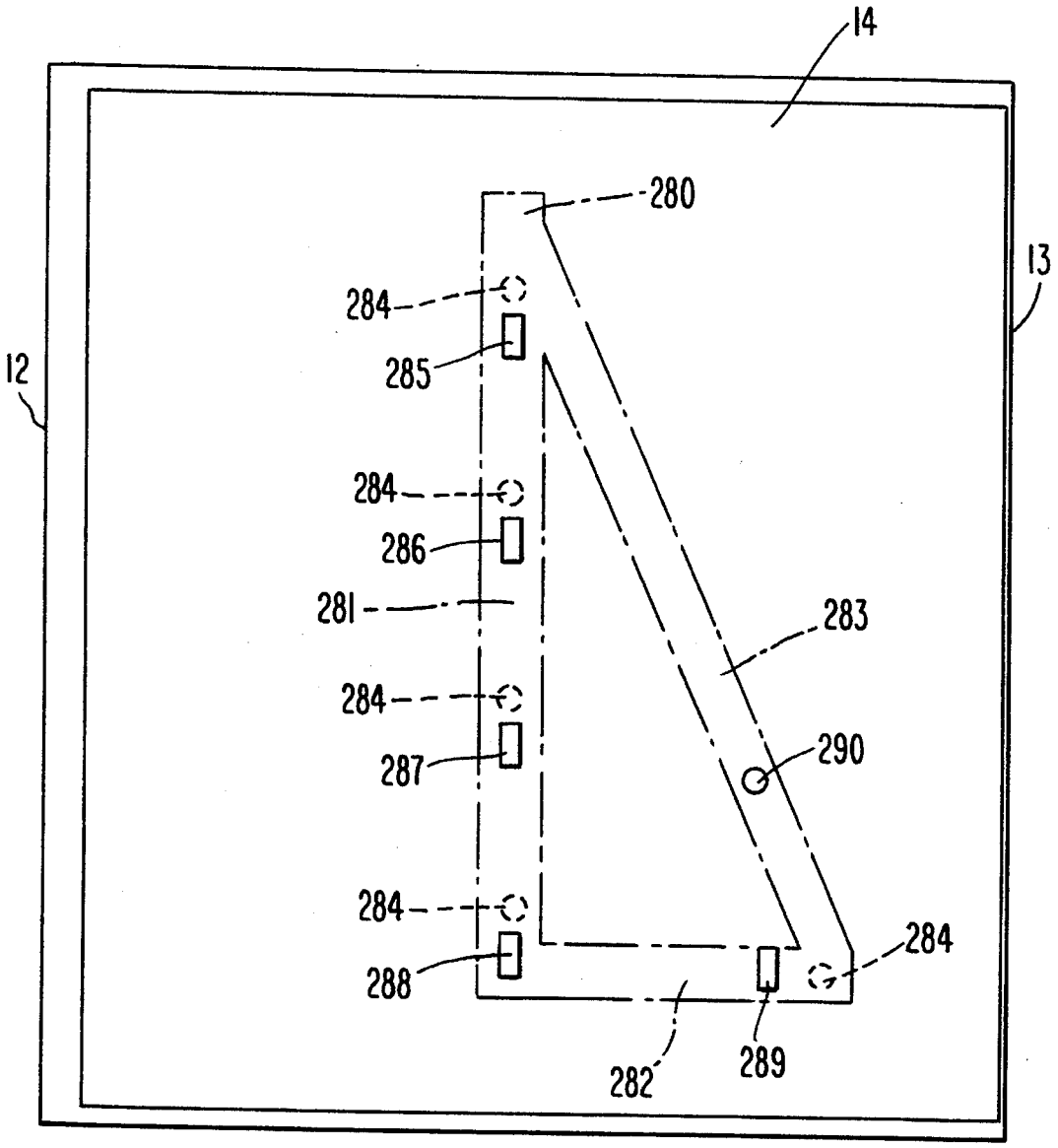
FIG. 11 is a partially schematic front view of the back cover of the vending apparatus of FIG. 1, including a mounting bracket, shown in phantom, for mounting the apparatus to a vertical wall, in accordance with the present invention.
Figure 12:
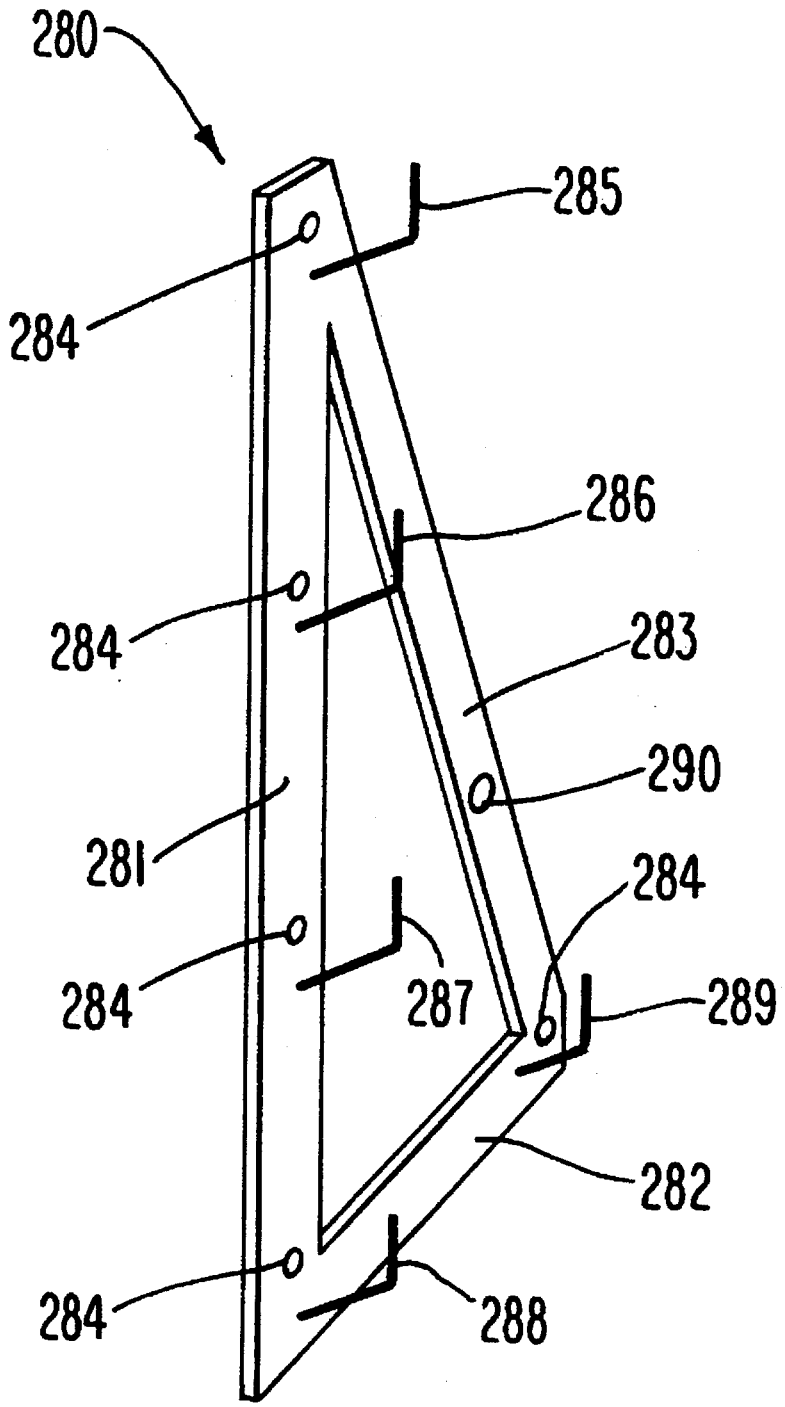
FIG. 12 is a partially schematic oblique view of the mounting bracket of FIG. 11.

FIGS. 11 and 12 illustrate a mounting bracket for securing the vending apparatus to a vertical wall in accordance with a preferred embodiment of the present invention. In FIG. 11, a vending apparatus similar to that of FIG. 1 is shown, with all but the back surface 14 and side surfaces 12 and 13 of the apparatus removed. A mounting bracket 280, shown in phantom behind the rear surface 14, includes a vertical arm 281 and a horizontal arm 282 connected by a diagonal connecting arm 283. The mounting bracket 280 is attached to a vertical wall or other surface (not shown) by fasteners 284 such as screws, bolts and the like. The fasteners 284 are preferably disposed in a substantially vertical line along the vertical arm 281 of the mounting bracket. In this manner, the fasteners 284 may be secured to a vertical wall stud or similar vertical support member. The fastener 284 provided at the right side of the horizontal arm 282 in FIG. 11 is optionally provided in order to further secure the mounting bracket 280 to the vertical wall or surface.

The mounting bracket 280 includes a series of coplanar mounting hooks 285, 286, 287, 288 and 289. The mounting hooks are inserted through corresponding openings in the back surface 14 of the vending apparatus in order to support the apparatus. In addition to openings in the back surface 14, other means may be provided on or near the back surface for engagement with the mounting hooks. For example, brackets, eyelets or any other suitable support members may be attached to the apparatus for engagement with the mounting hooks.

The mounting hooks are disposed non-linearly with respect to each other, with the mounting hooks 285, 286, 287 and 288 being located along a vertical line in FIG. 11, and the mounting hook 289 being disposed horizontally with respect thereto. This configuration provides for improved securement of the vending apparatus to the vertical wall such that twisting or rocking of the apparatus is less likely to result in the apparatus being dislodged from the wall. In order to provide additional securement, each mounting hook 285, 286, 287, 288 and 289 includes an extended vertical portion, shown most clearly in FIG. 12, that requires the vending apparatus to be lifted a significant distance before it can be removed from the mounting hooks.

The mounting bracket 280 also includes at least one through hole 290 that is preferably located in the diagonal connecting arm 283. However, the through hole 290 may be provided at any other suitable location on the mounting bracket 280. The back surface 14 of the vending apparatus includes a corresponding through hole that lines up with the through hole 290 of the mounting bracket 280 when the apparatus is secured to the bracket. Once the vending apparatus has been secured to the mounting bracket 280, which in turn has been secured to the vertical wall, a hole can be drilled into the wall through the through hole 290. A security bolt, toggle bolt or other suitable fastener may then be inserted from the inside of the snack machine through the through hole 290 into the wall to thereby securely hold the vending apparatus to both the mounting bracket and to the wall. Thus, if an unauthorized attempt is made to remove the vending apparatus from the wall, the security or toggle bolt extending through the through hole 290 would prevent such removal. Once the mounting hooks are inserted through the corresponding openings in the back surface 14 of the vending apparatus, and a security or toggle bolt is installed through the through hole 290, unauthorized removal of the vending apparatus from the wall is substantially prevented.

While a total of five mounting hooks are illustrated in FIGS. 11 and 12, it is understood that less or more mounting hooks can be used. At a minimum, it is preferred to use at least three mounting hooks that are disposed on the bracket non-linearly with respect to each other.

The vending apparatus of the present invention provides several advantages over conventional vending machines. The apparatus is compact, yet is capable of holding a large inventory of different articles. For example, in the preferred embodiment, the apparatus is only about 34 inches in height, 32 inches in width and 12 inches depth, but is capable of holding at least 122 separate snack products. Thus, the apparatus can hold an inventory comparable to conventional free-standing snack vending machines without taking up the volume and floor space required by such prior art machines.

The minimal depth or low profile of the present vending apparatus is a particular advantage over conventional snack vending machines. As shown most clearly in FIG. 3, the depth of the apparatus, defined as the distance between the front surface 11 and the back surface 14, is minimized by running the helical coils and horizontal shelves in a direction parallel with the front surface 11 of the apparatus. As opposed to conventional front-facing snack vending machines, the present apparatus moves articles to the side of the apparatus where they drop through a vertical shaft located at the side of the apparatus to a delivery area. This sideward movement, depicted most clearly in FIG. 2, eliminates any dead space at the front of the apparatus, thereby reducing the profile of the machine.

As shown in FIG. 3, the depth of the apparatus is essentially based on the diameter and number of helical coils provided in each row. For example, in the row containing the large helical coil 200 and the small helical coils 160 and 130, these coils occupy almost the entire distance between the back surface 14 and the front surface 11 of the apparatus. When all of the helical coils of the apparatus are loaded with snack articles, the articles essentially fill the entire volume of the apparatus, with the exception of the delivery area 30, the vertical 40 shaft and the mechanical area 44. An extremely space efficient configuration is therefor provided in accordance with the present invention.

The ability to slidingly remove each helical coil and/or motor from the apparatus without the use of tools is another highly advantageous feature of the present invention. If a particular helical coil motor is to be replaced, the motor can be quickly and easily removed from the apparatus, thereby substantially eliminating down time.

The adjustable shelf configuration, as illustrated in FIGS. 8–10, is another advantageous feature of the present invention. Through the use of extension shelves, adjustments can be made to accommodate articles of different sizes without the use of tools. Thus, for example, if relatively bulky articles are to be dispensed from a given helical coil and horizontal shelf, the extension shelf can be placed in the fully retracted position to allow the articles to properly fall from the horizontal shelf upon completion of one rotation of the helical coil. On the other hand, if relatively thin articles are to be dispensed, the extension shelf can be placed in the fully extended position, which allows the article to properly drop from the horizontal shelf while preventing the next article in line from dropping until the helical coil makes another rotation. In this manner, if the apparatus is shaken or jarred, the articles will not drop to the delivery area unless they have been paid for.

The mounting bracket for the vending apparatus of the present invention also provides significant advantages. The mounting bracket, as illustrated in FIGS. 11 and 12, securely fastens the vending apparatus to a vertical wall or surface in a manner that prevents unauthorized removal of the apparatus. In addition, the mounting bracket prevents tilting or shaking of the vending apparatus, which is a problem with conventional front-facing snack vending machines, thereby preventing the dispensing of articles that have not been paid for.

It is understood that the above description of the present invention is susceptible to considerable modification, change and adaptation by those skilled in the art, and that such modifications, changes and adaptations are intended to be considered within the scope of the present invention, which is set forth by the appended claims.

What is claimed is:

1. A vending apparatus comprising:

(a) an enclosure having front, back, and side surfaces;

(b) means for sequentially moving a plurality of articles within the enclosure in a substantially horizontal direction substantially parallel with the front surface of the enclosure to a position from which the articles drop through a substantially vertical shaft located adjacent to one of said side surfaces of the enclosure to a delivery area, wherein said means for sequentially moving said plurality of articles is disposed on a substantially horizontal shelf comprising means for adjusting the position from which the articles drop to facilitate the delivery of articles of different sizes; and (d) means for allowing removal of the articles from the delivery area.

2. The apparatus of claim 1, wherein the means for sequentially moving the articles in a substantially horizontal direction substantially parallel with the front surface of the enclosure comprises a plurality of motor driven helical coils.

3. The apparatus of claim 2, wherein each of the motor driven helical coils is driven by a motor that is slidably removable from the apparatus.

4. The apparatus of claim 2, wherein each of the helical coils is disposed in a containment channel comprising a substantially horizontal shelf below the coil and two substantially vertical walls on opposite sides of the coil.

5. A vending apparatus comprising:

(a) an enclosure having front, back, and side surfaces;

(b) means for sequentially moving a plurality of articles within the enclosure in a substantially horizontal direction substantially parallel with the front surface of the enclosure to a position from which the articles drop through a substantially vertical shaft located adjacent to one of said side surfaces of the enclosure to a delivery area, said means comprising a plurality of motor driven helical coils, wherein each of the helical coils is disposed in a containment channel comprising a substantially horizontal shelf below the coil and two substantially vertical walls on opposite sides of the coil; and (c) means for allowing removal of the articles from the delivery area;

wherein the substantially horizontal shelf comprises means for adjusting the position from which the articles drop to facilitate the delivery of articles of different sizes.

6. The apparatus of claim 1, wherein the means for sequentially moving the articles in a substantially horizontal direction substantially parallel with the front surface of the enclosure comprises a plurality of rows of helical coils.

7. The apparatus of claim 1, wherein the means for sequentially moving the articles in a substantially horizontal direction substantially parallel with the front surface of the enclosure comprises a plurality of columns of helical coils.

8. The apparatus of claim 1, wherein the means for sequentially moving the articles in a substantially horizontal direction substantially parallel with the front surface of the enclosure comprises a plurality of rows and columns of helical coils.

9. The apparatus of claim 8, wherein the apparatus comprises means for rotating at least one of the columns of helical coils away from at least one other of the columns of helical coils to facilitate loading of the articles into the apparatus.

10. The apparatus of claim 1, wherein the delivery area is accessible through the front surface of the enclosure.

11. The apparatus of claim 1, wherein the apparatus comprises a delivery slide disposed at a lower portion of the substantially vertical shaft and adapted to deflect the articles from substantially vertical movement in the substantially vertical shaft to substantially horizontal movement in the delivery area.

12. The apparatus of claim 11, wherein the delivery slide is moveable from a deflecting position to a blocking position that prevents access to the substantially vertical shaft to prevent theft of the articles from the apparatus.

13. The apparatus of claim 1, wherein the apparatus comprises means for mounting the apparatus to a substantially vertical surface.

14. A vending apparatus comprising:

(a) an enclosure having front, back, and side surfaces;

(b) means for sequentially moving a plurality of articles within the enclosure in a substantially horizontal direction substantially parallel with the front surface of the enclosure to a position from which the articles drop through a substantially vertical shaft located adjacent to one of said side surfaces of the enclosure to a delivery area;

(c) means for allowing removal of the articles from the delivery area; and (d) means for mounting the apparatus to a substantially vertical surface comprising a mounting bracket including at least three substantially co-planar fastening means disposed non-linearly with respect to each other, wherein the fastening means are removably engaged with engagement means provided on the back surface of the enclosure.

15. The apparatus of claim 1, wherein the front surface of the enclosure extends less than or equal to about 12 inches from the back surface of the enclosure.

16. The apparatus of claim 15, wherein the enclosure includes means to hold at least 100 snack articles.

17. A vending apparatus comprising:

(a) an enclosure having front, back, and side surfaces;

(b) means for sequentially moving a plurality of articles within the enclosure in a substantially horizontal direction substantially parallel with the front surface of the apparatus to a position from which the articles drop to a delivery area;

(c) means for allowing removal of the articles from the delivery area; and (d) means disposed on said back surface of said enclosure for mounting the apparatus to a substantially vertical surface which comprises a mounting bracket adapted for mounting to the substantially vertical surface and comprising at least three substantially co-planar fastening means disposed non-linearly with respect to each other.

18. The apparatus of claim 17, wherein the fastening means are removably engaged with engagement means provided on the back surface of the enclosure to support the apparatus on the mounting bracket.

19. The apparatus of claim 18, wherein the mounting bracket comprises at least one hole disposed therein, and the back surface of the enclosure comprises at least one hole disposed therein, wherein the holes are substantially aligned when the apparatus is supported on the mounting bracket, and are adapted to receive a fastening member that facilitates securement of the apparatus to the mounting bracket and to the substantially vertical surface.

* * * * *